United States Patent [19]

Baxter et al.

[11] Patent Number: 4,952,412

[45] Date of Patent: Aug. 28, 1990

[54] CRIMPING AND DECAPPING PRESS

[76] Inventors: James A. Baxter, 73a Friern Barnet Lane, London, United Kingdom, N20 OXT; Kenneth E. Marshall, Pinfold House, Almond Close, Barby, Rugby, Warwickshire, United Kingdom, CV23 8TL

[21] Appl. No.: 278,527

[22] Filed: Dec. 1, 1988

[30] Foreign Application Priority Data

Dec. 1, 1987 [GB] United Kingdom ..... 8728101

[51] Int. Cl.[5] ..... B67B 7/16

[52] U.S. Cl. ..... 425/383; 53/381 A

[58] Field of Search ..... 425/11, 12, 396, 517; 53/485, 488, 331, 366, 381 A; 215/324, 326, 327, 284, 304

[56] References Cited

U.S. PATENT DOCUMENTS

| | | | |
|---|---|---|---|
| 2,146,347 | 2/1939 | Pityo | 215/326 X |
| 2,738,089 | 3/1956 | Wenzel | 215/326 |
| 2,850,765 | 9/1958 | Rus | 425/517 X |
| 2,974,455 | 3/1961 | Ravn | 53/488 |
| 3,587,208 | 6/1971 | Berry et al | 53/381 A |
| 4,265,071 | 5/1981 | Smith et al. | 53/381 A X |
| 4,455,134 | 6/1984 | Biggs | 425/517 X |

FOREIGN PATENT DOCUMENTS

| | | | |
|---|---|---|---|
| 463699 | 8/1928 | Fed. Rep. of Germany . | |
| 1607989 | 8/1970 | Fed. Rep. of Germany | 215/324 |
| 926599 | 10/1947 | France . | |
| 266600 | 5/1950 | Switzerland . | |
| 308180 | 9/1955 | Switzerland . | |
| 555452 | 8/1943 | United Kingdom . | |

*Primary Examiner*—Richard L. Chiesa
*Attorney, Agent, or Firm*—Diller, Ramik & Wight

[57] ABSTRACT

The press comprises a base (1) carrying a column (2), an arm (3), which is displaceable along the column and retainable in a selected position thereon by a clamp means (4), the arm carrying an angularly displaceable cradle (11) for a working unit (26) for crimping or decapping, means (14) for locking the cradle in an operating position, a plunger (19) for operating the unit, and means (22–25) for actuating the plunger.

9 Claims, 2 Drawing Sheets

CRIMPING AND DECAPPING PRESS

BACKGROUND OF THE INVENTION

The invention relates to a crimping and decapping press for container closures, particularly for crimping and decapping caps of vials.

Crimpere and decappers of various sizes for the above purposes are known, most of them being of the pliers type having two pivotally interconnected hand-operated handles, one of which carries a crimping or decapping unit and the other an element for the actuation of the crimping or decapping unit.

These known crimpers and decappers have various disadvantages known to the users, one of which being that they soon tire the user.

SUMMARY OF THE INVENTION

The aim of the invention is to avoid or at least to mitigate these disadvantages. This is achieved by a crimping press according to the invention having the features hereinafter described and claimed.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
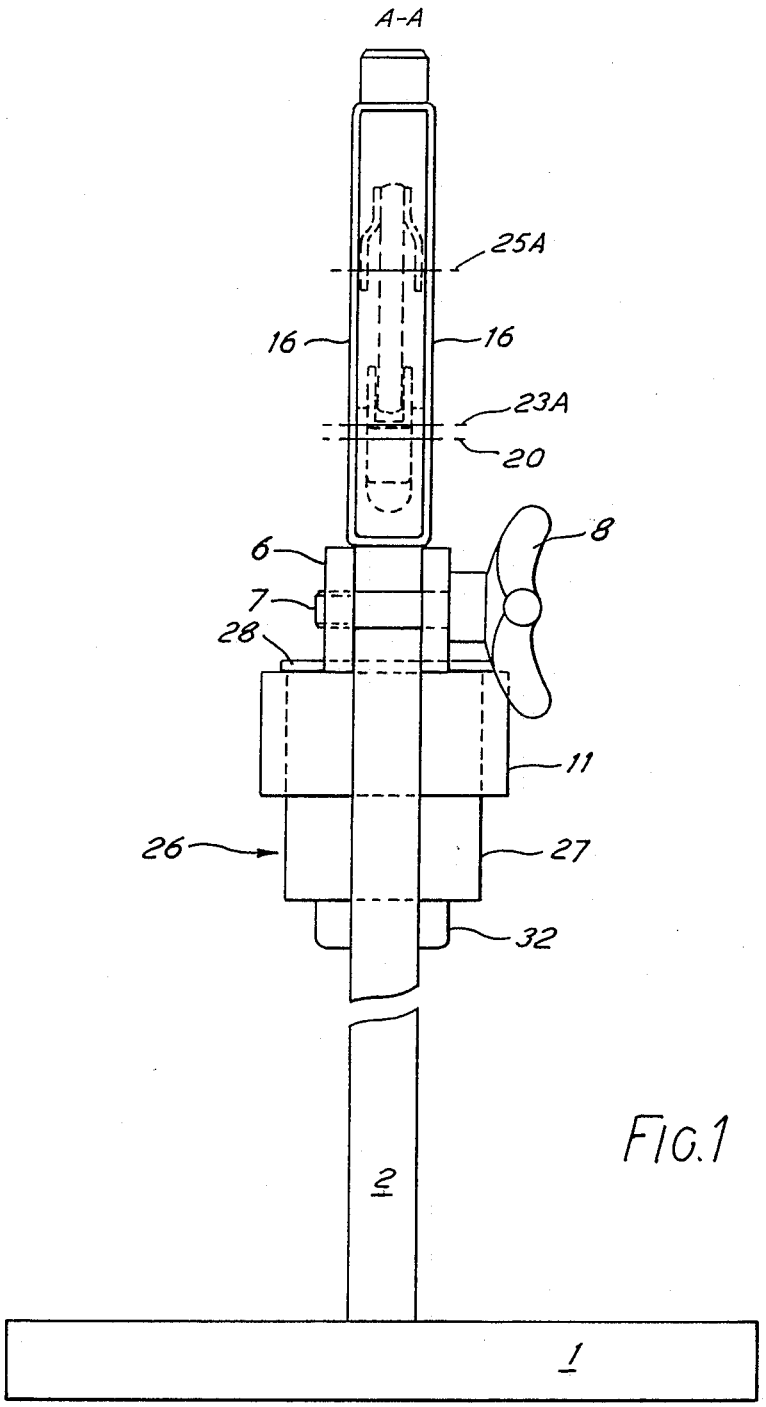
FIG. 1 shows a rear elevation of a press according to the invention.

The illustrated press comprises a base 1, made preferably of a metal plate intended to rest on the top of a desk or bench. The base 1, the size and weight of which are such as to give the press sufficient stability, carries an upright column 2 which is in the illustrated example of a uniform square-shaped cross-section. An arm 3 is mounted on the column 2 displaceably therealong. The arm 3 includes a clamp 4 having a solid front portion 5 and a forked rear portion 6 formed by two parallel arms. A screw 7 rotatable by a knob 8 passes through the arms of the forked rear portion 6. The clamp 4 is so positioned on the column 2 that the latter passes between the two arms between the solid front portion 5 and the screw 7. By rotation of the knob 8 the screw 7 can either press the arms together to clamp the clamp 4, and thereby the whole arm 3 at a desired part of the column 2, or release the arms to allow movement of the clamp 4 and thereby of the whole arm 3 along the column 2.

The press further comprises a carrier 9 having an arm 10 and a tubular cradle 11 for receiving a crimping or decapping unit. The carrier 9 is by its arm 10 mounted pivotally about a pivot pin 13 fixed to the solid front portion 5 of the clamp. The tubular cradle 11 is externally provided with a locating pin 14.

The arm 3 contains a control mechanism carried by the clamp 4. The control mechanism comprises two side walls 16 between which is pivotally mounted a locator 17 provided with a hole for receiving the locating pin 14 on the tubular cradle 11 of the carrier 9. When the locating pin 14 is received in the hole in the locator 17, the axis of the tubular cradle 11 passes between the side walls 16. Coaxially with this axis in the described position is situated between the walls 16 a plunger 19 provided with lateral guiding pins 20 extending into guiding slots 21 in the side walls 16 so that the plunger 19 is axially reciprocable by a lever mechanism 22.

The lever mechanism 22 comprises a first two-armed lever 23 which has unequal arms and its fulcrum is formed by a lower fixed pivot 23A. The shorter arm of the lever 23 is pivotally connected to the guiding pin 20 and the longer arm is pivotally connected to one end of a link 24, the other end of which is pivotally connected to the short arm of a bell-crank lever 25, the fulcrum of which is formed by an upper fixed pivot 25A and the longer arm of which serves as a manually operable handle. The locator 17 has an inclined upper surface which serves as a stop defining the maximum depression of the handle and consequently of the plunger 19.

It will be understood that the nearer an imaginary line passing through the centres of the pivots of the link 24 is to the upper fixed pivot 25A, the more pressure is exerted by the handle. For this reason a recess 24A is provided in the link 24. As a consequence of this design of the lever mechanism maximum pressure is obtained towards the end of the movement of the handle and therefore of the plunger 19, when it is most needed.

In the illustrated embodiment the cradle 11 of the press houses a crimping unit 26. The crimping unit 26 is of the collet-chuck type known per se and comprises a hollow cylindrical body 27 the outer diameter of which is slightly smaller than the inner diameter of the tubular cradle 11, so that the cradle 11 and the crimping unit 26 received therein are substantially coaxial. The body 27 is at the top provided with a peripheral flange 28 the outer diameter of which is greater than the inner diameter of the tubular cradle 11. As a consequence, each crimping unit 26 simply hangs through the cradle 11 suspended by its flange 28.

The body 27 contains a collet assembly formed by four identical collet elements 29 arranged uniformly about the axis of the crimping unit 26. The collet elements 29 are substantially two-armed levers, the fulcrum of which is formed by a ring 30 which is retained in the body 27 by a circlip, and each of which has an inner arm 31 and an outer arm 32 protruding from the crimping unit 26 and provided at its free end with an inwardly radiused forming projection 33. The inner arms 31 are biased by a resilient ring 34, e.g. a coiled spring ring, radially towards the axis of the unit 26 to that the forming projections 33 are normally in an open position in which they are radially spaced apart enough to enable insertion of the cap to be crimped.

The crimping unit 26 further comprises an actuator 35 which is situated axially in the body 26 and is axially displaceable between its normal raised position, to which it is biased by a spring 36, and a depressed position to which it may be transferred by the plunger 19. The actuator 35 includes a body 37 and a height-adjustable head 38 screwed therein and locable in a desired position by a nut 39. The body 37 carries a punch having at the top a frusto-conical portion 40 and at the bottom a pressure face 41 in the form of an inverted dish which has the size and shape of the upper part of the cap to be crimped.

Figure 2:
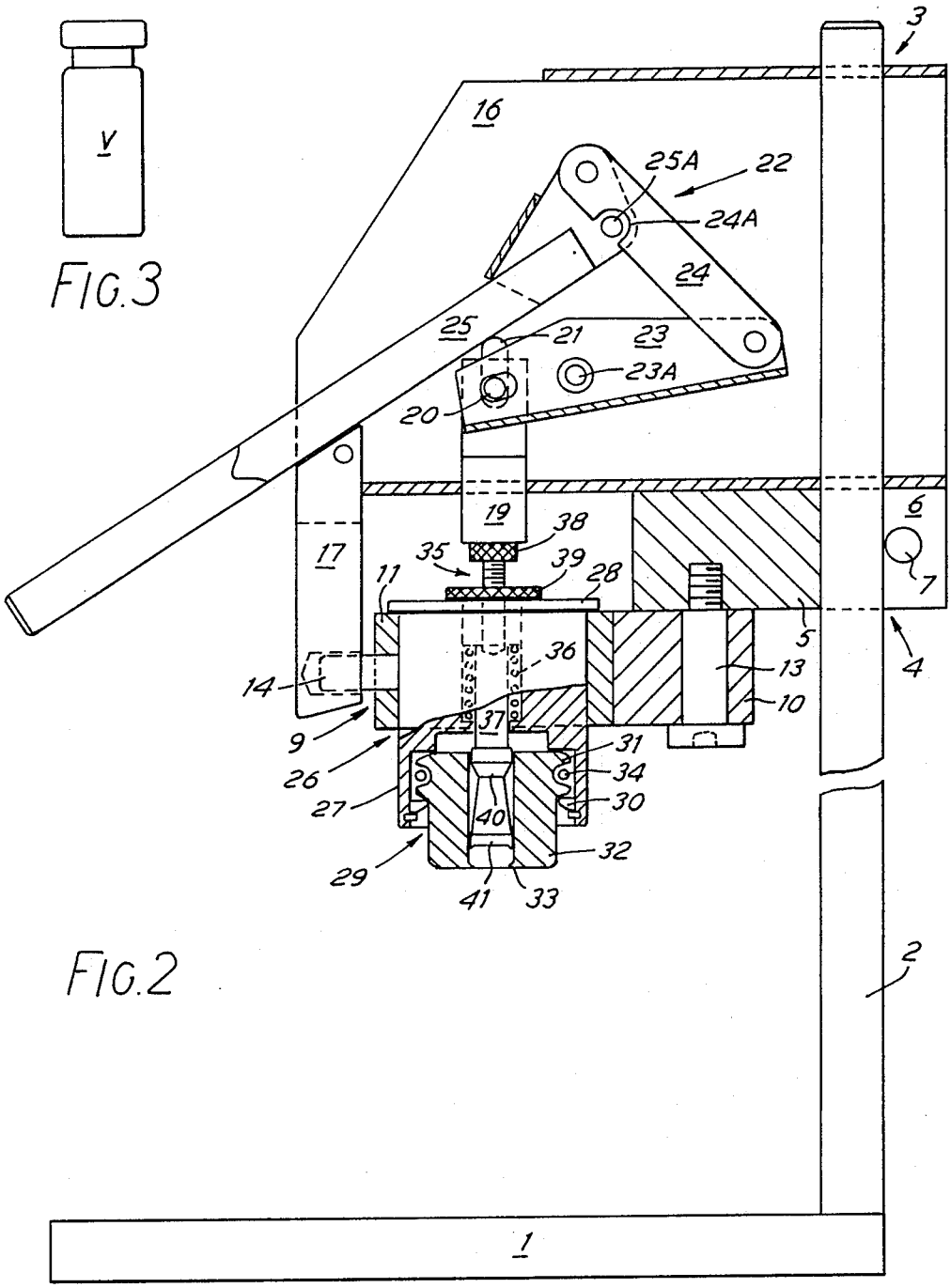
FIG. 2 shows a side elevation partly in section along the line A—A in FIG. 1.

When the actuator 35 is depressed by the plunger 19, it overcomes the forces exerted by the resilient ring 34 and the spring 36 and its frusto-conical portion 40 is forced between the inner arms 31 and displaces them radially outwardly, whereby the outer arms 32 and their forming projections 33 are displaced radially inwardly to a closed position shown in FIG. 2, in which their inward radiused surfaces converge towards the axis of the unit 26.

Figure 3:
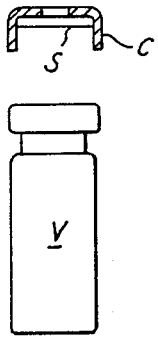
FIG. 3 shows a vial and a cap and seal therefor.

A press according to the invention when equipped with a crimping unit may be used for the crimping of various closures for various containers. Its operation will be described for simplicity in connection with a vial of the type used for autosamplers. FIG. 3 shows one such vial V having on top a neck ending in a collar which should be closed by a circular seal S and a cap C with a hole in the middle. In the drawing the thickness of the cap is exaggerated. In order to seal the vial V the seal S and cap C are positioned on the collar of the vial and inserted between the forming projections 33 when they are in the open position. Naturally, as mentioned earlier, the size of the cap C must correspond to the size of the pressure face 11. Then the outer arms 32 with their forming projections 33 are closed by the operation of the handle whereby the cap, seal and the collar of the vial are enclosed within the space defined between the outer arms 32 between the forming projections 33 and the pressure face 41. At this stage the outer arms 32 are fully closed but the cap has not yet been crimped and the handle of the press has not yet reached its end position. Further movement of the handle continues to press the actuator 34 towards the cap whereby the pressure face 41 starts exerting pressure on the cap and forcing the lower end of its skirt to follow the inward radiused surfaces of the forming projections 33 below the collar towards the neck of the vial. In this way the cap is crimped and the vial is perfectly sealed.

It will be appreciated that perfect sealing must take into consideration the actual thickess of the collar, the thickness of the seal S and the thickness of the material of the cap C. For this purpose the head 38 of the actuator 35 is adjustable, to achieve that at the end of the downward movement of the plunger 19 also the pressure face 41 is in the desired downward position which ensures perfect sealing having regard to the mentioned thicknesses of the cap, seal and collar.

A decapping head is similar to a crimping head, except that the design of the outer arms of the collet elements and the design of the punch are different to achieve deformation of the upper part of a crimped cap and its stripping off a vial.

Most of the advantages of a press according to the invention, such as the special design of the lever mechanism 22, stop for the handle and plunger 19 and provision of the actuator 35 with a height-adjustable head 38 have already been mentioned. A further advantageous feature is the easy exchangeability and replaceability of the crimping units 26, or similarly shaped and designed decapping units in the tubular cradle 11, which can either be locked by the locator 17 in an operating position or released and swung outwardly about the pivot pin 13 for easy replacement of the mentioned units. Furthermore, the means for operating the plunger 19 need not be the lever mechanism 22–25 but some other mechanical means, or else, pneumatic, hydraulic or electric means. Of these alternative means, electric means are preferred.

We claim:

1. A crimping and decapping press comprising a base carrying a column, an arm, said arm being displaceable along the column, clamp means for retaining said arm in one of several selected positions of displacement along said column, the arm carrying an angularly displaceable cradle, a working unit carried by said cradle for crimping or decapping, means for locking the cradle in an operating position, a plunger for operating the working unit, and means for actuating the plunger.

2. A press according to claim 1 wherein the plunger actuating means includes a lever mechanism, the mechanism being so designed that maximum pressure is obtained towards the end of the operating movement of the plunger.

3. A press according to claim 2 including a stop delimiting the end of the operating movement of the plunger.

4. A press according to claim 1 including a stop delimiting the end of the operating movement of the plunger.

5. A press according to claim 1 including a working unit which is of the collet-chuck type having a plurality of radially displaceable jaws and an axially displaceable punch for displacing the jaws, the unit including a height-adjustable head for actuating the punch so as to transmit to the latter the force exerted by the plunger.

6. A press according to claim 1 wherein the cradle is tubular and the working unit has a tubular body receivable and retainable in the cradle.

7. A press according to claim 1 wherein the means for actuating the plunger comprise one of pneumatic, hydraulic or electric means.

8. A press according to claim 1 including pivot means for effecting angular displacement of said cradle about an axis generally parallel to said column.

9. A press according to claim 8 wherein said locking means lock said cradle with said working unit below and in generally coaxially alignment with said plunger.

* * * * *